US007453432B2

(12) United States Patent
Nii

(10) Patent No.: US 7,453,432 B2
(45) Date of Patent: Nov. 18, 2008

(54) DISPLAY DEVICE FOR DISPLAYING AN IMAGE IF A POSITIVE VOLTAGE OR A NEGATIVE POLE VOLTAGE IS APPLIED AS AN IMAGE VOLTAGE TO A PIXEL ELECTRODE

(75) Inventor: Yusuke Nii, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 675 days.

(21) Appl. No.: 11/063,530

(22) Filed: Feb. 24, 2005

(65) Prior Publication Data

US 2005/0184950 A1 Aug. 25, 2005

(30) Foreign Application Priority Data

Feb. 25, 2004 (JP) ..... 2004-049831

(51) Int. Cl.
*G09G 3/36* (2006.01)

(52) U.S. Cl. ..... 345/98; 345/87

(58) Field of Classification Search ..... 345/960, 345/99, 98, 96, 95, 94, 93, 88, 87, 53, 55, 345/84, 89

See application file for complete search history.

(56) References Cited

U.S. PATENT DOCUMENTS 5,986,631 A * 11/1999 Nanno et al. ..... 345/94
5,990,979 A 11/1999 Koyama et al.
6,462,735 B2 10/2002 Naito
6,864,872 B2 * 3/2005 Yang ..... 345/94
6,975,297 B2 * 12/2005 Saishu et al. ..... 345/94
7,123,247 B2 * 10/2006 Morita ..... 345/204
2001/0015711 A1 8/2001 Aoki
2002/0044126 A1 * 4/2002 Aoki ..... 345/96
2002/0067326 A1 6/2002 Aoki
2003/0156086 A1 8/2003 Maeda et al.

FOREIGN PATENT DOCUMENTS

JP 02-184891 7/1990
JP 04-142513 5/1992
JP 7-175447 (A) 7/1995
JP 10-74066 (A) 3/1998
JP 2000-20037 (A) 1/2000
JP 2001-201732 7/2001

* cited by examiner

*Primary Examiner*—Chanh Nguyen
*Assistant Examiner*—Pegeman Karimi
(74) *Attorney, Agent, or Firm*—Harness, Dickey & Pierce, P.L.C.

(57) ABSTRACT

In a display device of the present invention, a positive pole voltage and a negative pole voltage at which flicker is less likely to occur are calculated in advance. In memory tables, as voltages to be applied to liquid crystal, data of the positive pole voltage is stored, and, instead of the negative pole voltage, a correction value that allows for calculating the negative pole voltage when used in combination with the positive pole voltage is stored. In this way, it is possible to make appearance of the flicker less likely. In addition, it is possible to reduce memory size (specifically, by $(A-B)\times 2^7$ bits) and thereby reduce packaging area and attain lower cost.

15 Claims, 5 Drawing Sheets

DISPLAY DEVICE FOR DISPLAYING AN IMAGE IF A POSITIVE VOLTAGE OR A NEGATIVE POLE VOLTAGE IS APPLIED AS AN IMAGE VOLTAGE TO A PIXEL ELECTRODE

This nonprovisional application claims priority under 35 U.S.C. § 119(a) on Patent Application No. 049831/2004 filed in Japan on Feb. 25, 2004, the entire contents of which are hereby incorporated by reference.

FIELD OF THE INVENTION

The present invention relates to display devices such as liquid crystal display devices.

BACKGROUND OF THE INVENTION

Conventionally, display devices such as liquid crystal display devices have been widely used. Examples of the liquid crystal display devices are disclosed in Japanese Publication for Laid-Open Patent Application, Tokukaihei 7-175447 (publication date: Jul. 14, 1995), Japanese Publication for Laid-Open Patent Application, Tokukaihei 10-74066 (publication date: Mar. 17, 1998), and Japanese Publication for Laid-Open Patent Application, Tokukai 2000-20037 (publication date: Jan. 21, 2000).

A liquid crystal display device disclosed in Tokukaihei 7-175447 has two tables: a positive pole table and a negative pole table.

In displaying a solid image, it is necessary that voltages applied to liquid crystal are equal on an n-th line and an (n+1)-th line.

If the liquid crystal causes no attraction or the like, a negative pole voltage can be calculated by calculating 1's complement of a positive pole voltage.

In general, liquid crystal causes attraction due to parasitic capacitances. The parasitic capacitances lower an image voltage, which is a potential of an image signal. That is, the parasitic capacitances lower a center voltage value of the image signal. The attraction becomes greater as the display becomes closer to blank display (blank display means White in Normal White display and Black in Normal Black display).

Depending on the directions of electric fields applied to the liquid crystal, voltages applied to the liquid crystal are different on the n-th line and the (n+1)-th line. As a result, flicker appears.

SUMMARY OF THE INVENTION

An object of the present invention is to provide a display device that is less likely to cause flicker.

To attain the foregoing object, a display device of the present invention is a display device for displaying an image when a positive pole voltage or a negative pole voltage is applied as an image voltage to a pixel electrode, an opposed voltage is applied to an opposed electrode, and a pixel voltage is applied to a pixel as a difference between the image voltage and the opposed voltage, wherein: the positive pole voltage and the negative pole voltage are determined with respect to each gradation, an opposed voltage at which flicker is minimized and a representing value of the opposed voltage are determined, and a difference between the opposed voltage and the representing value of the opposed voltage is calculated; the difference is added to the positive pole voltage and the negative pole voltage, the opposed voltage is set to the representing value, a gamma value is set to a predetermined value, a center voltage value and the opposed voltage are fixed, and, while changing gradations, the positive pole voltage and the negative pole voltage are adjusted so that values of the positive pole voltage and the negative pole voltage are on a gradation-luminance curve that is associated with the gamma value; if one of the positive pole voltage or the negative pole voltage is a first pole voltage, and the other of the positive pole voltage or the negative pole voltage is a second pole voltage, a value of the first pole voltage is stored in a voltage data storing section; and a correction value, which is a difference between a value of the second pole voltage and 1's complement of the value of the first pole voltage, is stored in the voltage data storing section, the display device further including a voltage data generating section for calculating a value of the second pole voltage that is associated with the value of the first pole voltage, by using the first pole voltage and the correction value at a time of display processing.

A voltage applied to the liquid crystal is referred to as an image voltage; a voltage applied to the opposed electrode is referred to as an opposed voltage; a difference between the image voltage and the opposed voltage, the difference being applied to a pixel, is referred to as a pixel voltage, and one-half of the amplitude of the image voltage and one-half of the amplitude of the opposed voltage are referred to as center voltage values of the image voltage and the opposed voltage, respectively. Since AC driving is performed, the image voltage has two values. The value higher than the opposed voltage is referred to as the positive pole voltage, and the value lower than the opposed voltage is referred to as the negative pole voltage.

According to this arrangement, first, the positive pole voltage and the negative pole voltage are determined with respect to each gradation. An opposed voltage at which flicker is minimized and a representing value of the opposed voltage are determined. Then, a difference between the opposed voltage and the representing value of the opposed voltage is calculated, and the difference is added to the positive pole voltage and the negative pole voltage. The opposed voltage is set to the representing value.

Next, a gamma value is set to a predetermined value (e.g. 2.5), the center voltage value and the opposed voltage are fixed, and, while changing gradations, the positive pole voltage and the negative pole voltage are adjusted by using a luminance meter or the like so that values of the positive pole voltage and the negative pole voltage are on a gradation-luminance curve that is associated with the gamma value.

Next, if one of the positive pole voltage or the negative pole voltage is a first pole voltage, and the other of the positive pole voltage or the negative pole voltage is a second pole voltage, a value of the first pole voltage is stored in a voltage data storing section. Instead of storing a value of the second pole voltage, a correction value that is a difference between the value of the second pole voltage and 1's complement of the value of the first pole voltage is stored in the voltage data storing section.

At a time of display processing, a value of the second pole voltage that is associated with the value of the first pole voltage is calculated by using the first pole voltage and the correction value.

Thus, instead of storing data of the negative pole voltage, the correction value that allows for calculating a desired negative pole voltage when used in combination with the value of the positive pole voltage is stored in the voltage data storing section. Alternatively, instead of storing data of the positive pole voltage, the correction value that allows for calculating a desired positive pole voltage when used in combination with the value of the negative pole voltage is stored in the voltage data storing section.

As a result, for example, even if the number of bits required for each data is eight bits in the case where data of the negative pole voltage is stored in the voltage data storing section, the number of bits required can be reduced to four bits, for example.

Therefore, compared to the case where data of the negative pole voltage is stored in the voltage data storing section, the amount of data to be stored in the voltage data storing section can be reduced.

Thus, the foregoing arrangement has an effect that it is possible to realize a display device that can make appearance of the flicker less likely in any set gradation, reduce the variation of the positive pole voltage and the negative pole voltage between gradations, obtain a correct luminance that can attain a desired gradation with respect to each set gradation, and reduce the stress on the capacity of the voltage data storing section.

In addition to having the foregoing arrangement, the display device of the present invention is such that the number of bits B of the correction value is determined so that the following inequality is satisfied:

$$Vgpp \times H\max/2^B < VA/KD$$

where Vgpp is a peak-to-peak voltage of a gate voltage in a pixel transistor; Hmax is a maximum value of variation of attraction; B is the number of bits of the correction value; VA is an amplitude of the image signal; and KD is the number of gradations allocated to each gamma value.

According to this arrangement, the number of bits B of the correction value is determined so as to satisfy the foregoing inequality.

Therefore, the amount of data to be stored in the voltage data storing section can be reduced more easily. Thus, in addition to the effect of the foregoing arrangement, there is an effect that the stress on the capacity of the voltage data storing section can be reduced more easily.

In addition to having the foregoing arrangement, the display device of the present invention is such that the number of bits of the correction value is one-half of the number of bits of the value of the first pole voltage.

According to this arrangement, the number of bits of the correction value is one-half of the number of bits of the value of the first pole voltage.

Therefore, the amount of data to be stored in the voltage data storing section can be reduced more certainly. Thus, in addition to the effect of the foregoing arrangement, there is an effect that the stress on the capacity of the voltage data storing section can be reduced more certainly.

To solve the foregoing problems, a display device of the present invention is a display device for displaying an image when a positive pole voltage or a negative pole voltage is applied as an image voltage to a pixel electrode, an opposed voltage is applied to an opposed electrode, and a pixel voltage is applied to a pixel as a difference between the image voltage and the opposed voltage, wherein: the positive pole voltage and the negative pole voltage are determined with respect to each gradation, an opposed voltage at which flicker is minimized and a representing value of the opposed voltage are determined, and a difference between the opposed voltage and the representing value of the opposed voltage is calculated; the difference is added to the positive pole voltage and the negative pole voltage, the opposed voltage is set to the representing value, a gamma value is set to a predetermined value, a center voltage value and the opposed voltage are fixed, and, while changing gradations, the positive pole voltage and the negative pole voltage are adjusted so that values of the positive pole voltage and the negative pole voltage are on a gradation-luminance curve that is associated with the gamma value; if one of the positive pole voltage or the negative pole voltage is a first pole voltage, and the other of the positive pole voltage or the negative pole voltage is a second pole voltage, a value of the first pole voltage is stored in a voltage data storing section; and a correction value is stored in the voltage data storing section, the correction value being a value that allows for calculating a desired value of the second pole voltage when used in combination with the first pole voltage, and the number of bits required for the correction value being smaller than the number of bits required for the value of the second pole voltage, the display device further including a voltage data generating section for calculating a value of the second pole voltage that is associated with the value of the first pole voltage, by using the first pole voltage and the correction value at a time of display processing.

A voltage applied to the pixel electrode is referred to as an image voltage; a voltage applied to the opposed electrode is referred to as an opposed voltage; a difference between the image voltage and the opposed voltage, the difference being applied to a pixel, is referred to as a pixel voltage, and one-half of the amplitude of the image voltage and one-half of the amplitude of the opposed voltage are referred to as center voltage values of the image voltage and the opposed voltage, respectively. Since AC driving is performed, the image voltage has two values. The value higher than the opposed voltage is referred to as the positive pole voltage, and the value lower than the opposed voltage is referred to as the negative pole voltage.

According to this arrangement, first, the positive pole voltage and the negative pole voltage are determined with respect to each gradation. An opposed voltage at which flicker is minimized and a representing value of the opposed voltage are determined. Then, a difference between the opposed voltage and the representing value of the opposed voltage is calculated, and the difference is added to the positive pole voltage and the negative pole voltage. The opposed voltage is set to the representing value.

Next, a gamma value is set to a predetermined value (e.g. 2.5), the center voltage value and the opposed voltage are fixed, and, while changing gradations, the positive pole voltage and the negative pole voltage are adjusted by using a luminance meter or the like so that values of the positive pole voltage and the negative pole voltage are on a gradation-luminance curve that is associated with the gamma value.

Next, if one of the positive pole voltage or the negative pole voltage is a first pole voltage, and the other of the positive pole voltage or the negative pole voltage is a second pole voltage, a value of the first pole voltage is stored in a voltage data storing section. Instead of storing a value of the second pole voltage, a correction value is stored in the voltage data storing section. The correction value is a value that allows for calculating a desired value of the second pole voltage when used in combination with the value of the first pole voltage, and the number of bits required for the correction value is smaller than the number of bits required for the value of the second pole voltage.

At a time of display processing, a value of the second pole voltage that is associated with the value of the first pole voltage that is associated with the value of the first pole voltage is calculated by using the first pole voltage and the correction value.

Thus, instead of storing data of the negative pole voltage, the correction value that allows for calculating a desired negative pole voltage when used in combination with the value of the positive pole voltage is stored in the voltage data storing section. Alternatively, instead of storing data of the positive pole voltage, the correction value that allows for calculating a desired positive pole voltage when used in combination with the value of the negative pole voltage is stored in the voltage data storing section.

As a result, for example, even if the number of bits required for each data is eight bits in the case where data of the negative pole voltage is stored in the voltage data storing section, the number of bits required can be reduced to four bits, for example.

Therefore, compared to the case where data of the negative pole voltage is stored in the voltage data storing section, the amount of data to be stored in the voltage data storing section can be reduced.

Thus, the foregoing arrangement has an effect that it is possible to realize a display device that can make appearance of the flicker less likely in any set gradation, reduce the variation of the positive pole voltage and the negative pole voltage between gradations, obtain a correct luminance that can attain a desired gradation with respect to each set gradation, and reduce the stress on the capacity of the voltage data storing section.

For a fuller understanding of the nature and advantages of the invention, reference should be made to the ensuing detailed description taken in conjunction with the accompanying drawings.

DESCRIPTION OF THE EMBODIMENTS

The present embodiment is an active matrix liquid crystal display device. The following is an outline of the display device of the present embodiment. First, a positive pole voltage and a negative pole voltage that are less likely to cause flicker are calculated. Then, in memory tables of a voltage data storing section, positive pole voltage data is stored as a voltage to be applied to liquid crystal (pixel voltage), and a corrected value is stored. The corrected value is not the negative pole voltage but a value that allows for calculating the negative pole voltage when used in combination with the positive pole voltage. This arrangement can make appearance of flicker less likely. In addition, it is possible to reduce the memory size and thereby reduce packaging area and attain lower cost.

First, an arrangement of a comparative example is described.

Figure 1:
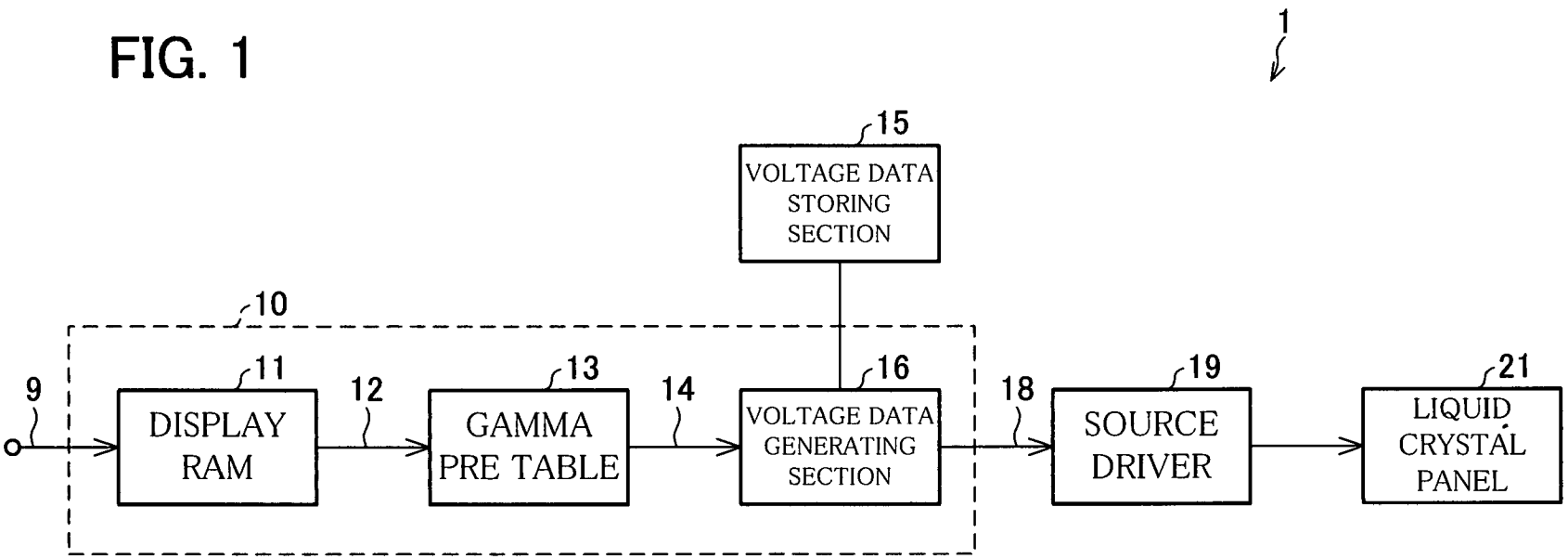
FIG. 1 is a block diagram illustrating an arrangement of major parts of a display device in accordance with an embodiment of the present invention.

As shown in FIG. 1, a display device 1 includes an LCDC (liquid crystal display controller) 10, a voltage data storing section 15, a source driver 19, and a liquid crystal panel 21. The LCDC 10 includes a display RAM 11, a gamma pre table 13, and a voltage data generating section 16. The members shown in FIG. 1 can be those of known arrangements, except the voltage data generating section 16 of the present embodiment. Therefore, these members are not described in detail. Other members, such as a gate driver, are also provided by using those of known arrangements, but are not shown or described here.

In the description below, "x:y:z" indicates that the number of bits of image signal data (voltages applied to liquid crystal) of R (red), G (green) and B (blue) are x, y, and z, respectively.

For example, image signal data 9 of "8:8:8" is inputted to the LCDC 10 from an external device such as a host of a portable phone.

The display RAM 11 thins out the input data and obtain image signal data 12 of "5:6:5".

The image signal data 12 is corrected by a bit conversion circuit (not shown) and the gamma pre table 13 in the LCDC 10, so as to obtain image signal data 14 of "7:7:7". Possible gamma values are 1.0, 1.8, 2.2, and 2.5.

The image signal data 14 is obtained by bit conversion of the image signal supplied from the main body of the external device. The image signal data 14 is used by the voltage data generating section 16 in order to access the voltage data storing section 15, which includes memory tables. Since the image signal data 14 is "7:7:7", the number of possible addresses of the image signals R, G and B is $2^7$. Voltage data associated with the addresses are stored in the memory tables of the voltage data storing section 15. Different addresses are referred to in accordance with gradations and gamma values.

The reference numeral 15 indicates the voltage data storing section, which has the memory tables storing voltages to be applied to the liquid crystal.

Figure 2:
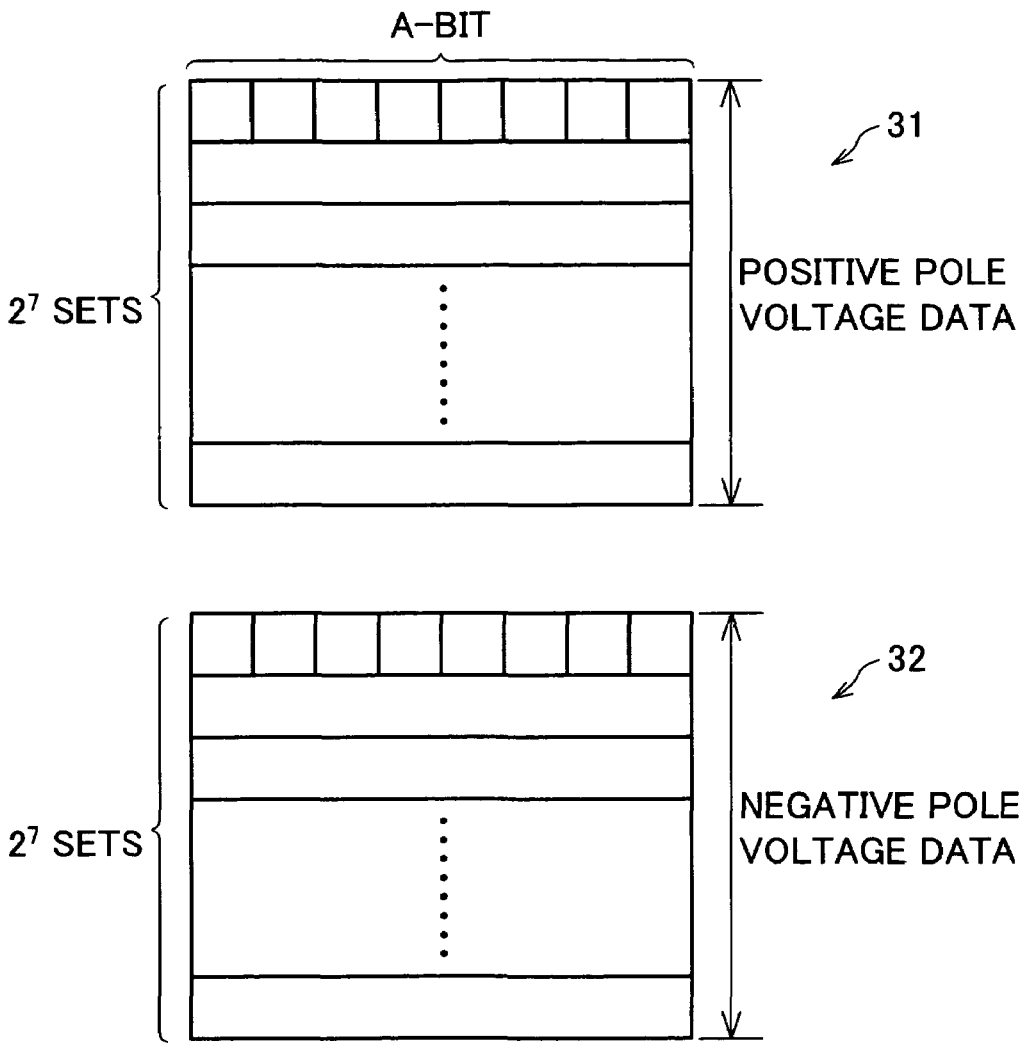
FIG. 2 is a diagram illustrating memory tables in a comparative example.

As shown in FIG. 2, in the comparative example, the size of the memory tables is (A-bit data)$\times 2^7 \times 2$. One (A-bit data)$\times 2^7$ is a positive pole voltage data table 31 storing a positive pole voltage that is a part of an image voltage. The other (A-bit data)$\times 2^7$ is a negative pole voltage data table 32 storing a negative pole voltage that is also a part of the image voltage. Since each of R, G and B in this example is seven bits, the number of bits of the A-bit data is 27. However, this number is not limited to seven.

These data are stored in a rewritable IC called EEPROM (Electrically Erasable Programmable ROM) provided on an FPC (Flexible Printed Circuit).

If there is no attraction, the negative pole voltage can be 1's complement of the positive pole voltage. Therefore, it is not necessary to store the negative pole voltage in the memory table. In reality, however, there is attraction, and such a result of calculation would cause the problem of flicker. An attraction voltage ΔV is represented by $$\Delta V = Vgpp \times Cgd/(Clc+Ccs+Cgd)$$

where Vgpp is a peak-to-peak voltage of a gate voltage in a pixel transistor; Clc is a capacitance of the liquid crystal; Ccs is an auxiliary capacitance; and Cgd is a parasitic capacitance. In this formula, Clc tends to increase as the voltage applied to the liquid crystal increases. Therefore, the attraction voltage is not a constant; it varies depending on the voltage applied to the liquid crystal. If the state when the image voltage (negative pole voltage) is lower than an opposed voltage is state 1 and the state when the image voltage (positive pole voltage) is higher than the opposed voltage is state 2, an electric field between a pixel electrode and an opposed electrode has different directions when there is a transition from state 1 to state 2 and when there is a transition from state 2 to state 1. This results in different Clc. Thus, Clc has a hysteresis property.

Due to these various factors, it is impossible to simply adopt 1's complement of the positive pole voltage as the negative pole voltage. Instead, a negative pole voltage desirable for the purpose of display (that is, a negative pole voltage that causes little flicker) is determined in advance and stored in the memory table.

Figure 3:
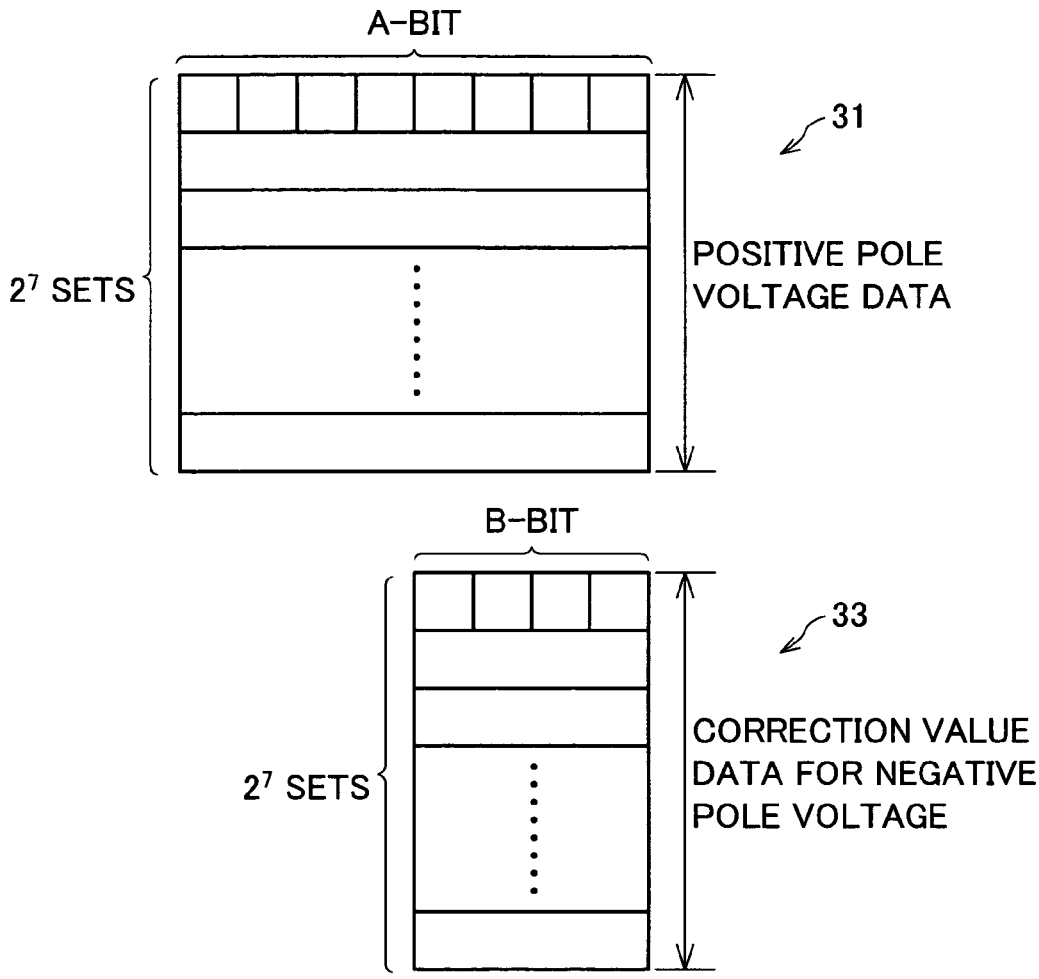
FIG. 3 is a diagram illustrating memory tables in the embodiment.

As shown in FIG. 3, in the present embodiment, the size of the memory tables is (A-bit data)$\times 2^7$+(B-bit data)$\times 2^7$. Here, B<A, preferably B<<A.

(A-bit data)$\times 2^7$ is a positive voltage data table 31 storing a positive pole voltage that is a part of an image voltage. (B-bit data)$\times 2^7$ is a correction value table 33 storing a correction value for calculating the negative pole voltage, instead of storing the negative pole voltage that is a part of the image voltage.

As in the foregoing case, these data are stored in a rewritable IC called EEPROM provided on an FPC.

In the comparative example, as shown in FIG. 2, the voltage data generating section 16 selects (reads) image signal data from the memory tables of the voltage data storing section 15 with respect to the positive pole voltage and the negative pole voltage. The source driver 19 uses the image signal data on the liquid crystal panel 21 as image signal data with an optimal voltage to be applied to the liquid crystal. The voltage to be applied to the liquid crystal is applied to each pixel of the liquid crystal panel 21 through source signal lines. As a result, an image is displayed. In order to apply a voltage to a pixel in accordance with data by using the source driver 19, the gate driver (not shown) and the like, a known mechanism is used. Therefore, the mechanism is not described here.

On the other hand, in the present embodiment, as shown in FIG. 1, the voltage data generating section 16 selects image signal data with respect to the positive pole voltage from the memory table of the voltage data storing section 15. With respect to the negative pole voltage, as described later, the voltage data generating section 16 selects (reads) a correction value associated with the positive pole voltage from the memory table of the voltage data storing section 15. Then, the negative pole voltage is calculated by a circuit in the display device, and used as the voltage to be applied to the liquid crystal.

Figure 4:
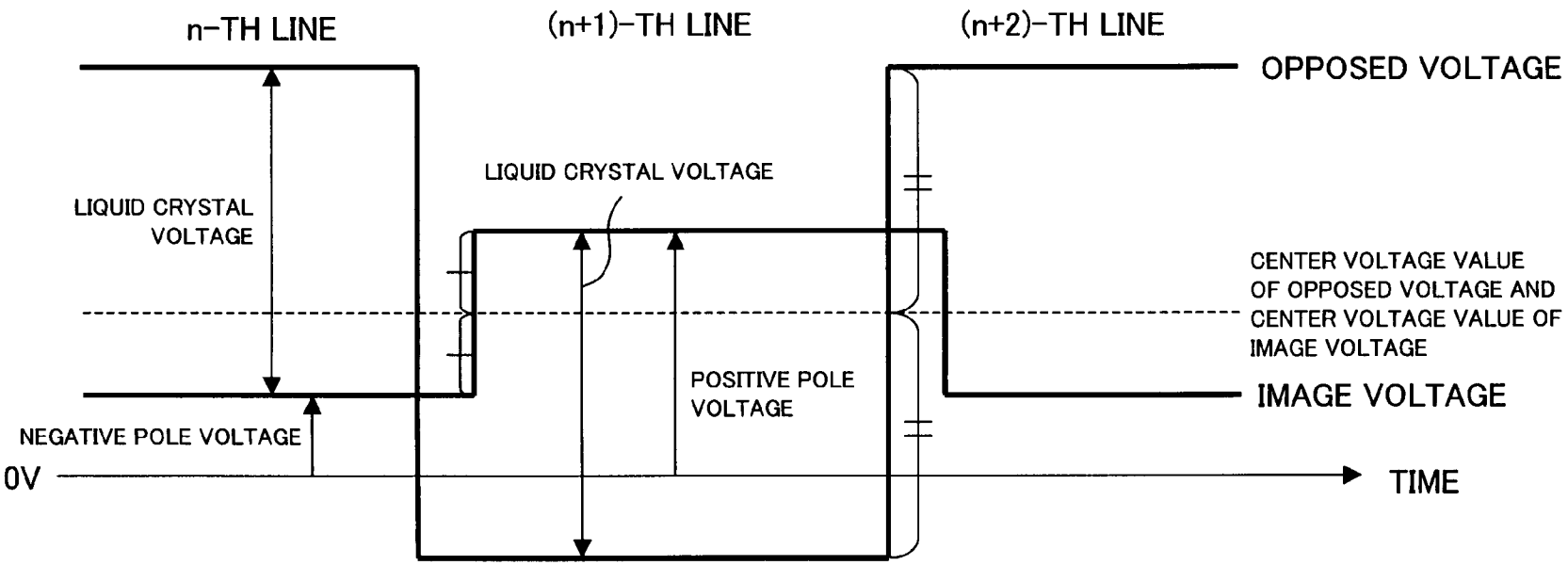
FIG. 4 is a diagram illustrating relationships among a positive pole voltage, a negative pole voltage, and an opposed voltage.

When the voltage to be applied to the liquid crystal is at maximum in line inversion dot sequential driving, the relationship between positive pole voltage data and negative pole voltage data in the memory tables of the voltage data storing section 15 is as shown in FIG. 4.

The image voltage has either one of two values, that is, the positive pole voltage or the negative pole voltage. The opposed voltage may be an AC voltage or a DC voltage. In the present embodiment, the opposed voltage is an AC voltage.

As described above, in the case where the voltage to be applied to the liquid crystal is at maximum, it is necessary that voltages applied to liquid crystal are equal on an n-th line and an (n+1)-th line, as shown in FIG. 4. If the liquid crystal causes no attraction or the like, the negative pole voltage can be 1's complement of the positive pole voltage. In general, liquid crystal causes attraction, which decreases the image voltage (potential of an image signal). In other words, the attraction decreases a center voltage value of the image signal. The attraction becomes greater as the voltage applied to the liquid crystal is lower. The pixel voltages that decrease the center voltage value are different between the n-th line and the (n+1)-th line. As a result, flicker appears.

To solve this problem, in the present embodiment, the negative pole voltage obtained as 1's complement is corrected, so that the same voltage is applied to the liquid crystal on the n-th line and the (n+1)-th line (i.e. so that flicker is caused to the same degree).

The following outlines how to calculate the correction value (details are provided later in (step 1) to (step 3)). First, a center voltage value (of an image signal) that minimizes the flicker is actually measured with respect to each gradation. In other words, the center voltage value of the opposed voltage and the center voltage value of the image signal are equalized.

Next, based on the center voltage value actually measured, the negative pole voltage is calculated as follows:

(the center voltage value of the image signal)−the amplitude of the image signal/2

Finally, the correction value is determined by subtracting 1's complement of the positive pole voltage from the negative pole voltage thus calculated. In the present embodiment, instead of the negative pole voltage, the correction value is stored in the memory table at the time of manufacturing the display device.

Figure 5:
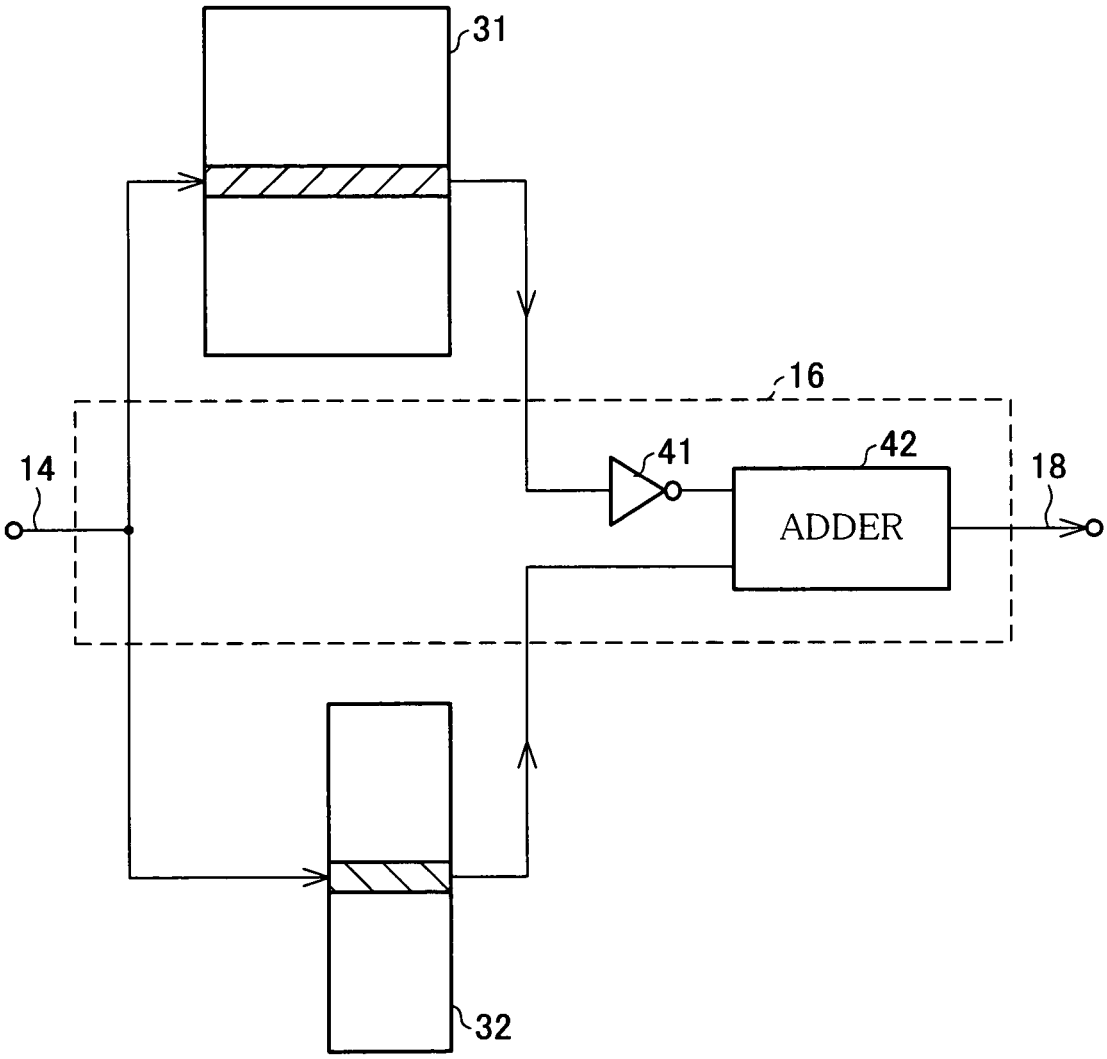
FIG. 5 is a diagram illustrating how a voltage data generating section generates the negative pole voltage in order to perform display processing.

At the time of display processing, in the display device, the negative pole voltage is calculated based on the correction value and the positive pole voltage that is associated with the correction value. Specifically, as shown in FIG. 5, the voltage data generating section 16 in the display device includes an inverter 41 that receives the positive pole voltage data obtained from the memory table. The inverter 41 outputs 1's complement of the positive pole voltage. An adder 42 adds the output of the inverter 41 and the correction value obtained from the memory table, and outputs the result. An appropriate known arrangement may be adopted as a circuit arrangement for selecting and outputting the positive pole voltage. Therefore, the circuit arrangement is not shown or described.

In the comparative example, calculation of the voltage to be applied to the liquid crystal requires two kinds of data: the positive pole voltage data and the negative pole voltage data of the voltage to be applied to the liquid crystal. Therefore, there is a drawback that memory size and capacitance are large.

In contrast, in the present embodiment, the negative voltage data is calculated by the method described above, and this is used instead of the negative pole voltage. As a result, it is possible to reduce memory size (specifically, by (A−B)$\times 2^7$ bits) and thereby reduce packaging area and attain lower cost.

(Step 1)

A voltage applied to the liquid crystal is referred to as an image voltage; a voltage applied to the opposed electrode is referred to as an opposed voltage; a difference between the image voltage and the opposed voltage, the difference being applied to a pixel, is referred to as a pixel voltage, and one-half of the amplitude of the image voltage and one-half of the amplitude of the opposed voltage are referred to as center voltage values of the image voltage and the opposed voltage, respectively. Since AC driving is performed, the image voltage has two values. The value higher than the opposed voltage is referred to as the positive pole voltage, and the value lower than the opposed voltage is referred to as the negative pole voltage.

First, with reference to, for example, the specification of each pixel, an engineer tentatively determines the positive pole voltage and the negative pole voltage with respect to each gradation, by calculating with a computer or the like.

While considering the attraction of the positive pole voltage and the attraction of the negative pole voltage with respect to each gradation, the engineer changes the opposed voltage. Then, the voltage applied to the liquid crystal of the liquid crystal panel is measured by using a luminance meter or the like, so as to calculate an opposed voltage that causes a desired flicker, that is, an opposed voltage that causes no appearance of flicker or substantially no appearance of flicker (that is, a flicker of such a level that no substantive problem occurs). Such an opposed voltage is represented by VF(n), where n is a number representing a gradation, n=1, 2, 3, . . . , N (N is a value indicating the number of gradations).

More specifically, the luminance of the liquid crystal panel is measured by using a luminance meter (not shown), and luminance data is converted into a voltage value by using an oscilloscope (not shown). The more the flicker is, the larger the amplitude of the voltage waveform. The opposed voltage is determined based on the engineer's observation of the voltage waveform.

Next, the engineer determines an intermediate value of VF(1) to VF(N) as a representing value VCF. For example, an average value of VF(1) to VF(N) can be adopted as VFC.

Next, difference opposed voltages ΔVF(n) are calculated as follows:

$$\Delta VF(1)=VF(1)-VFC,$$

$$\Delta VF(2)=VF(2)-VFC,$$

$$\Delta VF(3)=VF(3)-VFC, \ldots,$$

$$\Delta VF(n)=VF(n)-VFC, \ldots,$$

$$\Delta VF(N)=VF(N)-VFC$$

With respect to each gradation, ΔVF(n) is added both to the positive pole voltage and the negative pole voltage.

The opposed voltage is set to the representing voltage.

By the foregoing step, it is possible to determine a positive pole voltage, a negative pole voltage, and an opposed voltage at which (i) flicker is less likely to appear in any set gradation and (ii) the positive pole voltage and the negative pole voltage do not vary significantly between gradations.

(Step 2)

At the stage immediately after Step 1, a correct luminance that can attain a desired gradation is not necessarily obtained with respect to each set gradation. Therefore, the next step is to set a gamma value to a predetermined value (e.g. 2.5); keep the center voltage values and the opposed voltage constant, and, by using a luminance meter or the like and while changing gradations, adjust the positive pole voltage and the negative pole voltage, so that the value is on a gradation-luminance curve that is associated with the set gamma value. If necessary, this adjustment processing is repeated several dozen times. The adjustment method may be a certain method such as linear interpolation, and calculation can be performed by a computer or the like.

More specifically, the luminance of the liquid crystal panel is measured by using a luminance meter (not shown) or the like. Then, luminance data is plotted on a graph of luminance and gradation, and the luminance data is compared with the gradation-luminance curve.

Note that there is the following relationship. By the definition of the pixel voltage, the pixel voltage=the amplitude of the image voltage/2+the amplitude of the opposed voltage/2.

Meanwhile, the amplitude of the image voltage=(the positive pole voltage−the negative pole voltage)/2.

Therefore, the pixel voltage=(the positive pole voltage−the negative pole voltage)/2+the amplitude of the opposed voltage/2 (1)

By the definition of the center voltage value, the center voltage value=(the positive pole voltage+the negative pole voltage)/2 (2)

In Step 2, the center voltage value and the opposed voltage are constant. Therefore, it is found that, if one of the pixel voltage, positive pole voltage, or negative pole voltage is determined, the other two are also determined from the formulas (1) and (2).

In this case, the center voltage value of the image voltage and the center voltage value of the opposed voltage are equal, and the negative pole voltage=(the center voltage value of the opposed voltage)−(the positive pole voltage−the center voltage value of the opposed voltage)

By the foregoing step, it is possible to determine such a positive pole voltage, a negative pole voltage, and an opposed voltage that flicker is less likely to appear in any set gradation, the positive pole voltage and the negative pole voltage do not vary significantly between gradations, and a correct luminance that can attain a desired gradation can be obtained with respect to each set gradation.

(Step 3)

In the comparative example, the positive pole voltage and the negative pole voltage are stored in the memory tables prepared in advance in the display device.

On the other hand, in the present embodiment, among the positive pole voltage, negative pole voltage, and opposed voltage obtained as described above, the positive pole voltage (first pole voltage) is stored in the memory table. With regard to the negative pole voltage (second pole voltage), data of a correction value is stored, instead of storing the negative pole voltage. The correction value has a predetermined relationship with the negative pole voltage (hereinafter VN (n); n is a number representing a gradation, as described above) calculated in Step 2 with respect to each positive pole voltage. In other words, such a correction value that allows for calculating a desired negative pole voltage when used in combination with the value of the positive pole voltage is stored.

In this case, a formula for calculating the correction value is determined so that the number of bits required for the correction value is smaller than the number of bits required for the negative pole voltage (second pole voltage). For example, the correction value may be a difference between the negative pole voltage and 1's complement of the positive pole voltage.

In other words, the predetermined relationship may be, for example, the difference between the negative pole voltage and 1's complement of the positive pole voltage.

By using the positive pole voltage (hereinafter VP (n); n is a number representing a gradation, as described above) calculated in Step 2, 1's complement of the positive pole voltage (hereinafter VQ(n)) is calculated. This is a correct negative pole voltage on the assumption that there is no attraction. Then, a difference ΔVM(n) between VQ(n) and the negative pole voltage (hereinafter VN (n); n is a number representing a gradation, as described above) calculated in Step 2 with respect to each positive pole voltage is calculated as the correction value as follows:

$$\Delta VM(n)=VN(n)-VQ(n)$$

Instead of the data of the negative pole voltage, ΔVM(n) is stored in the memory table, as the correction value associated with each positive pole voltage.

The data to be stored can be calculated as follows, for example:

the positive pole voltage=(the data for the positive pole voltage to be stored in the memory table)×$VD/K$ the correction value=(the data for the correction value to be stored in the memory table)×$VD/K$ where VD is a driving voltage (e.g. VD=3.3V in the case of 3.3V driving); and K is the number of gradations (e.g. K=256 in the case of 256 gradations).

For example, the positive pole voltage can be eight bits, and the correction value can be four bits. As described above, the attraction voltage $\Delta V = Vgpp \times Cgd/(Clc+Ccs+Cgd)$ In general, variation of the attraction on the liquid crystal panel is 3% to 5%, approximately. Thus, the maximum value of the variation of the attraction is 5%.

If the peak-to-peak voltage of the gate voltage in a pixel transistor is Vgg=15V, the variation of the attraction voltage is 15×0.05=0.75V. If this voltage is divided by (the number of bits of the correction value) power of two, that is, by the fourth power of two (16), a resolution of the correction value is obtained. Therefore, 0.75/16=0.0469V is the resolution of the correction value.

The data of the positive pole voltage is eight bits, and, in the present invention, allocated to four gamma values (i.e. 1.0, 1.8, 2.2, and 2.5). Therefore, $2^8/2^4=64$ gradations are allocated to each gamma value. The amplitude of a image signal 3.3V divided by 64 (gradations) is 0.05156V. Thus, 0.05156V is allocated to one bit. From the fact that $$0.0469V<0.05156V,$$

it is found that the resolution of the correction value exceeds the resolution of the positive pole voltage. Therefore, the number of bits of the correction value can be four bits.

Thus, parameters required for calculating the correction value (correction bits) are, for example, (i) the variation of the attraction (especially the maximum value), which depends on the material of the liquid crystal and on the panel circuit, (ii) the amplitude of the image signal, and (iii) the gradations used. Based on these parameters, the number of bits B of the correction value is set so that the following inequality is satisfied, as can be understood from the description above:

$$Vgpp \times H\max/2^B < VA/KD$$

where Vgpp is the peak-to-peak voltage of the gate voltage in a pixel transistor; Hmax is the maximum value of the variation of the attraction; B is the number of bits of the correction value; VA is the amplitude of the image signal; and KD is the number of gradations allocated to each gamma value.

In this way, it is easy to reduce the amount of data to be stored in the memory tables. Therefore, it is easy to reduce the stress on the capacity of the memory tables.

Moreover, as in the present embodiment, the number of bits of the correction value that satisfies the foregoing inequality (four bits) is as small as one-half of the number of bits of the first pole voltage. Thus, the amount of data to be stored in the memory tables can be reduced more certainly. Therefore, it is possible to reduce the stress on the capacity of the memory tables more certainly.

Thus, the formula (difference) for calculating the correction value is determined so that the number of bits required for the correction value is smaller than the number of bits required for the second pole voltage.

By thus storing in the memory table such a correction value that allows for calculating the desired negative pole voltage when used in combination with the value of the positive pole voltage, it is possible to realize a display device that can make appearance of the flicker less likely, reduce the variation of the positive pole voltage and the negative pole voltage between gradations, obtain a correct luminance that can attain a desired gradation with respect to each set gradation, and reduce the stress on the memory capacity of the memory tables.

In the foregoing example, the positive pole voltage is stored in the memory table, and the correction value that allows for calculating the desired negative pole voltage when used in combination with the value of the positive pole voltage is stored in the memory table. However, this arrangement may be reversed by storing the negative pole voltage in the memory table and storing, in the memory table, a correction value that allows for calculating a desired positive pole voltage when used in combination with the value of the negative pole voltage.

At the time of actual display, when a gradation is instructed, the voltage data generating section 16 refers to the memory tables of the voltage data storing section 15 (the positive pole voltage data table 31 and the negative pole voltage data table 33), so as to determine the positive pole voltage (VP(n)) and the correction value (ΔVM(n)) for that gradation. Then, as described with reference to FIG. 5, the voltage data generating section 16 calculates the negative pole voltage by using the positive pole voltage and the correction value, according to the following formula:

$$VN(n)=\Delta VM(n)+VQ(n)$$

According to the positive pole voltage and the negative pole voltage thus calculated, the source driver 19 applies a voltage to a pixel electrode through a source signal line.

The present invention makes the appearance of the flicker less likely. Therefore, the present invention is applicable to such purposes as liquid crystal display devices.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display device for displaying an image when a positive pole voltage or a negative pole voltage is applied as an image voltage to a pixel electrode, an opposed voltage is applied to an opposed electrode, and a pixel voltage is applied to a pixel as a difference between the image voltage and the opposed voltage, wherein:

the positive pole voltage and the negative pole voltage are determined with respect to each gradation, an opposed voltage at which flicker is minimized and a representing value of the opposed voltage are determined, and a difference between the opposed voltage and the representing value of the opposed voltage is calculated;

the difference is added to the positive pole voltage and the negative pole voltage, the opposed voltage is set to the representing value, a gamma value is set to a predetermined value, a center voltage value and the opposed voltage are fixed, and, while changing gradations, the positive pole voltage and the negative pole voltage are adjusted so that values of the positive pole voltage and the negative pole voltage are on a gradation-luminance curve that is associated with the gamma value;

if one of the positive pole voltage or the negative pole voltage is a first pole voltage, and the other of the positive pole voltage or the negative pole voltage is a second pole voltage, a value of the first pole voltage is stored in a voltage data storing section; and a correction value, which is a difference between a value of the second pole voltage and 1's complement of the value of the first pole voltage, is stored in the voltage data storing section, the display device further comprising a voltage data generating section for calculating a value of the second pole voltage that is associated with the value of the first pole voltage, by using the first pole voltage and the correction value at a time of display processing.

2. The display device as set forth in claim 1, wherein:

the center voltage value=(the positive pole voltage+ the negative pole voltage)/2.

3. The display device as set forth in claim 1, wherein:

the voltage data storing section has a size for storing $2^n$ sets of A-bit data of the first pole voltage and $2^n$ sets of B-bit data of the correction value, where A, B, and n are natural numbers and B<A.

4. The display device as set forth in claim 1, wherein:

the number of bits B of the correction value is determined so that the following inequality is satisfied:

$$Vgpp \times Hmax/2^B < VA/KD$$

where Vgpp is a peak-to-peak voltage of a gate voltage in a pixel transistor; Hmax is a maximum value of variation of attraction; B is the number of bits of the correction value; VA is an amplitude of the image signal; and KD is the number of gradations allocated to each gamma value.

5. The display device as set forth in claim 4, wherein:

the number of bits of the correction value is one-half of the number of bits of the value of the first pole voltage.

6. The display device as set forth in claim 1, wherein:

when a solid image is displayed, the pixel voltage using the first pole voltage and the second pole voltage are equal on an n-th line and an (n+1)-th line.

7. The display device as set forth in claim 1, wherein:

the representing value of the opposed voltage is an average value of the opposed voltage at which the flicker is minimized on each gradation.

8. The display device as set forth in claim 1, wherein:

at the time of display processing, the voltage data generating section calculates 1's complement of the value of the first pole voltage, and adds the correction value to the 1's complement so as to calculate a value of the second pole voltage that is associated with the value of the first pole voltage.

9. A display device for displaying an image when a positive pole voltage or a negative pole voltage is applied as an image voltage to a pixel electrode, an opposed voltage is applied to an opposed electrode, and a pixel voltage is applied to a pixel as a difference between the image voltage and the opposed voltage, wherein:

the positive pole voltage and the negative pole voltage are determined with respect to each gradation, an opposed voltage at which flicker is minimized and a representing value of the opposed voltage are determined, and a difference between the opposed voltage and the representing value of the opposed voltage is calculated;

the difference is added to the positive pole voltage and the negative pole voltage, the opposed voltage is set to the representing value, a gamma value is set to a predetermined value, a center voltage value and the opposed voltage are fixed, and, while changing gradations, the positive pole voltage and the negative pole voltage are adjusted so that values of the positive pole voltage and the negative pole voltage are on a gradation-luminance curve that is associated with the gamma value;

if one of the positive pole voltage or the negative pole voltage is a first pole voltage, and the other of the positive pole voltage or the negative pole voltage is a second pole voltage, a value of the first pole voltage is stored in a voltage data storing section; and a correction value is stored in the voltage data storing section, the correction value being a value that allows for calculating a desired value of the second pole voltage when used in combination with the first pole voltage, and the number of bits required for the correction value being smaller than the number of bits required for the value of the second pole voltage, the display device further comprising a voltage data generating section for calculating a value of the second pole voltage that is associated with the value of the first pole voltage, by using the first pole voltage and the correction value at a time of display processing.

10. The display device as set forth in claim 9, wherein:

the center voltage value=(the positive pole voltage+ the negative pole voltage)/2.

11. The display device as set forth in claim 9, wherein:

the voltage data storing section has a size for storing $2^n$ sets of A-bit data of the first pole voltage and $2^n$ sets of B-bit data of the correction value, where A, B, and n are natural numbers and B<A.

12. The display device as set forth in claim 9, wherein:

the number of bits B of the correction value is determined so that the following inequality is satisfied:

$$Vgpp \times Hmax/2^B < VA/KD$$

where Vgpp is a peak-to-peak voltage of a gate voltage in a pixel transistor; Hmax is a maximum value of variation of attraction; B is the number of bits of the correction value; VA is an amplitude of the image signal; and KD is the number of gradations allocated to each gamma value.

13. The display device as set forth in claim 12, wherein:

the number of bits of the correction value is one-half of the number of bits of the value of the first pole voltage.

14. The display device as set forth in claim 9, wherein:

when a solid image is displayed, the pixel voltage using the first pole voltage and the second pole voltage are equal on an n-th line and an (n+1)-th line.

15. The display device as set forth in claim 9, wherein:

the representing value of the opposed voltage is an average value of the opposed voltage at which the flicker is minimized on each gradation.

* * * * *